US010976042B1

(12) United States Patent
Chen

(10) Patent No.: US 10,976,042 B1
(45) Date of Patent: Apr. 13, 2021

(54) HIGH OUTPUT SOCKET POWER ADAPTER

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 17/065,015

(22) Filed: Oct. 7, 2020

Related U.S. Application Data

(60) Provisional application No. 62/931,938, filed on Nov. 7, 2019, provisional application No. 62/913,422, filed on Oct. 10, 2019.

(51) Int. Cl.

| | |
|---|---|
| ***F21V 23/06*** | (2006.01) |
| ***H01R 24/28*** | (2011.01) |
| ***H01R 24/76*** | (2011.01) |
| ***G09F 13/22*** | (2006.01) |
| ***F21V 23/02*** | (2006.01) |
| *F21Y 115/10* | (2016.01) |

(52) U.S. Cl.
CPC ..... *F21V 23/06* (2013.01); *F21V 23/023* (2013.01); *G09F 13/22* (2013.01); *H01R 24/28* (2013.01); *H01R 24/76* (2013.01); *F21Y 2115/10* (2016.08); *G09F 2013/222* (2013.01)

(58) Field of Classification Search
CPC ..... F21V 23/06; F21V 23/023; H01R 24/28; H01R 24/76; G09F 13/22; G09F 2013/222; F21Y 2115/10
See application file for complete search history.

(56) References Cited

U.S. PATENT DOCUMENTS

| | | | | |
|---|---|---|---|---|
| 10,107,481 | B1 * | 10/2018 | Chen | F21S 8/08 |
| 2015/0055370 | A1 * | 2/2015 | Gongola | G09F 13/18 362/612 |
| 2015/0356893 | A1 * | 12/2015 | Lipton | G09F 13/00 700/264 |
| 2020/0114809 | A1 * | 4/2020 | Chen | B60Q 1/44 |

FOREIGN PATENT DOCUMENTS

| | | | | |
|---|---|---|---|---|
| WO | WO-2009036594 | A1 * | 3/2009 | H05B 45/37 |

* cited by examiner

*Primary Examiner* — Rajarshi Chakraborty
*Assistant Examiner* — Glenn D Zimmerman
(74) *Attorney, Agent, or Firm* — Stuart M. Goldstein

(57) ABSTRACT

A power adapter for LED module lighting systems has an orifice for receiving and maintaining an LED modular lighting stick inserted with the orifice, a female electrical receptacle for receiving an electrical plug extending from the LED modular lighting stick, and openings for electrical plugs which are connected to an electrical power supply board. In this manner, high voltage electrical power from the power supply board is converted to lower voltage electrical power to the LED modular lighting stick.

5 Claims, 4 Drawing Sheets

HIGH OUTPUT SOCKET POWER ADAPTER

RELATED APPLICATION

This application claims the benefit of provisional application 62/913,422 filed on Oct. 10, 2019 and provisional application 62/931,938 filed on Nov. 7, 2019.

BACKGROUND OF THE INVENTION

In order to use LED module lighting sticks to light signage, it is currently necessary to install High Output (HO) sockets and ballast into the sign. Wires are run to each of the HO sockets so that when the lighting sticks are clicked into the sockets, electrical power is distributed to each lamp. When using retrofitted lighting sticks, it is necessary to insert end caps on the lighting sticks, or on the extrusions on which the lighting sticks are based, into the existing sockets for each lighting stick. It is then necessary to remove the old ballast and install new power supplies. Next, electrical wires need to be run from the power supplies, i.e. electrical wiring from each separate power supply, to each individual LED module lighting stick. In this case, the HO sockets act essentially as LED stick holders.

There are currently no devices or other means which assist in eliminating the many electrical components involved in the installation of LED module lighting sticks into HO sockets and in reducing the time it takes for these installations and for retrofits.

SUMMARY OF THE INVENTION

It is thus the object of the present invention to provide a high output socket power adapter which addresses the disadvantages and limitations associated with the installation and retrofit of LED module lighting sticks into HO sockets.

This and other objects are accomplished by the present invention, a high output socket power adapter which acts as a clean connection between the LED module lighting stick and the HO socket. The power adapter has an orifice for receiving and maintaining an LED modular lighting stick inserted into the orifice, a female electrical receptacle for receiving an electrical plug extending from the LED modular lighting stick, and openings for electrical plugs which are connected to an electrical power supply board. In this manner, high voltage electrical power to the power supply board is converted to lower voltage electrical power to the LED modular lighting stick.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
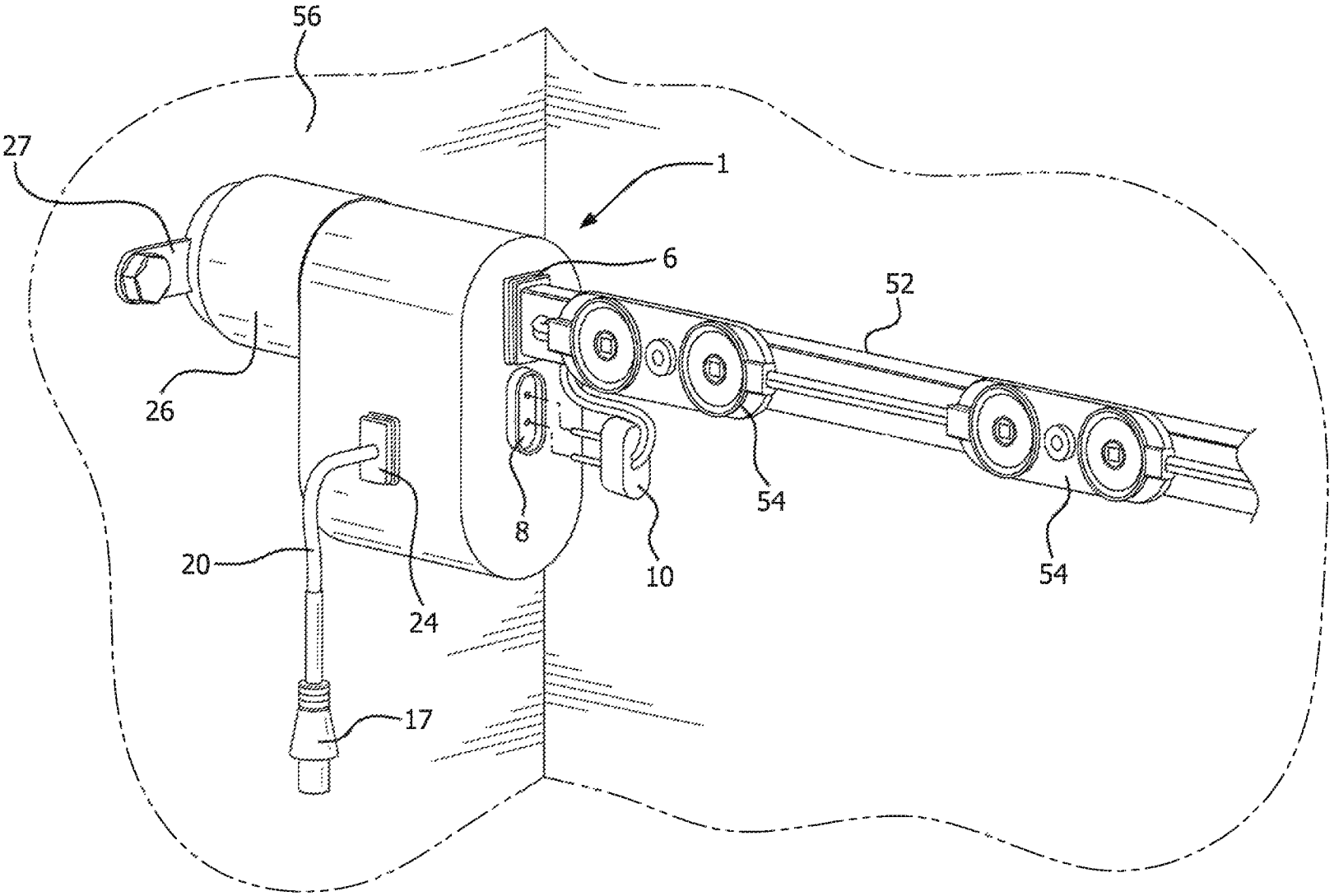
FIG. 1 is a perspective view of the power adapter of the present invention showing its use with an LED modular lighting stick.
Figure 2:
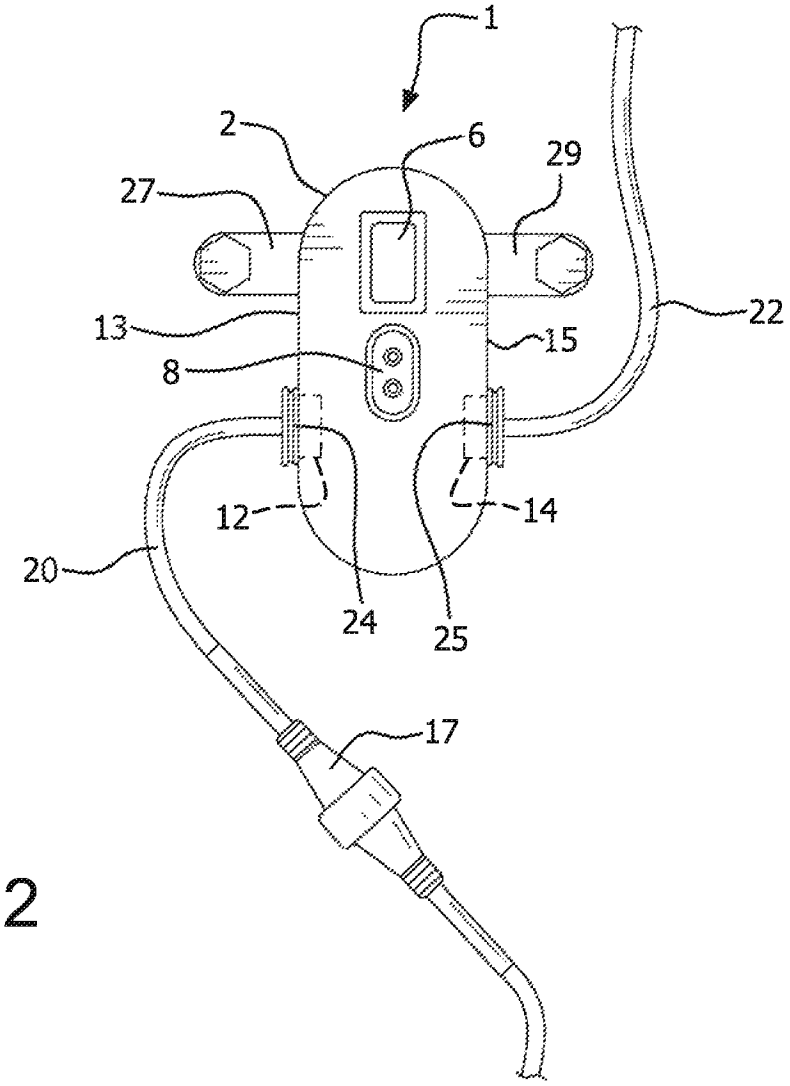
FIG. 2 is a front view of the power adapter of the present invention.

Power adapter 1 of the present invention comprises housing 2 containing electric power supply board 4. See FIG. 3. Housing 2 comprises orifice 6 for receiving the end of LED module lighting stick 52, having LED modules 54. Female electrical receptacle 8 in housing 2 is configured to receive male electrical plug 10 extending from lighting stick 52 and openings 12 and 14 through side walls 13 and 15 are configured to allow passage of electrical connectors, e.g. plugs 24 and 25, through the side walls in order to provide electrical power to and from supply board 4. Electrical wiring 20 and 22 are connected to plugs 24 and 25. Terminal connectors 17 and 19 are provided at the terminus of the wiring.

By this configuration, high voltage electrical power, e.g. in the range of 90 volts-277 volts, received via wiring 22, is inputted to power supply board 4 which is configured to convert this high voltage electrical power to lower voltage electrical power, e.g. in the range of 5 volts-24 volts, to the LED module lighting stick.

Power adapter 1 is connected to mounting component 26 which provides for the attachment of the power adapter to lamp signage system support frame 56 via bolt connected brackets 27 and 29. Mounting component 26 can also be configured as a male socket element which can be inserted into an existing HO socket.

Figure 4:
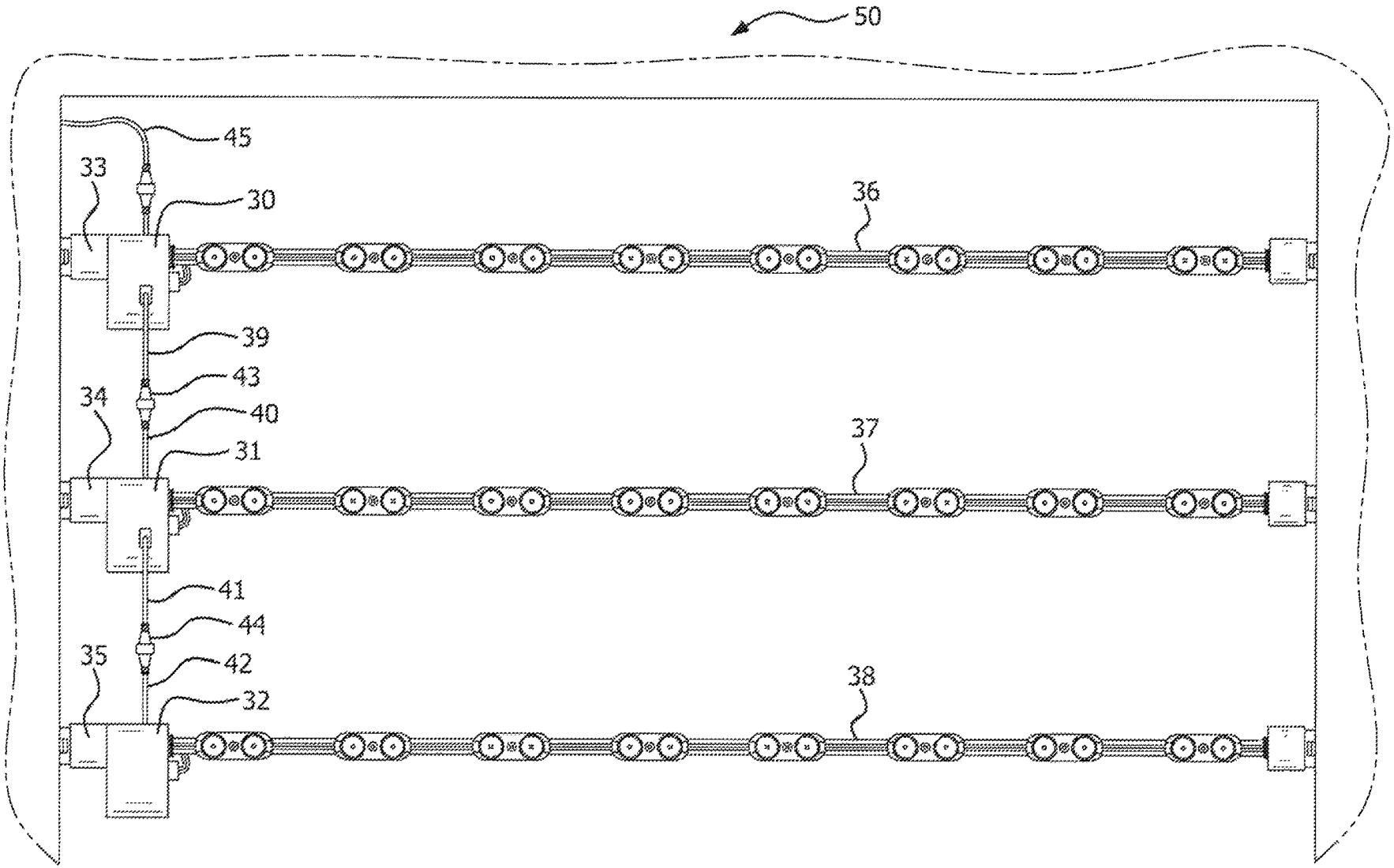
FIG. 4 illustrates the use of a plurality of power adapters of the present invention in a lamp signage system.

FIG. 4 illustrates the use of power adapter 1 in lamp signage system 50. A plurality of power adapters 30, 31, and 32 are attached to electrical lamp signage frame 56 via mounting components 33, 34, and 35. LED module lighting sticks 36, 37, and 38 are simply inserted into power adapters 30, 31, and 32, with the ends of the lighting sticks inserted into the orifices and their electrical plugs inserted into the electrical receptacle of each power adapter. See, for example, the insertion of LED module lighting stick 52 into orifice 6 and plug 10 inserted into electrical receptacle 8 of power adapter 1 in FIG. 1.

Figure 3:
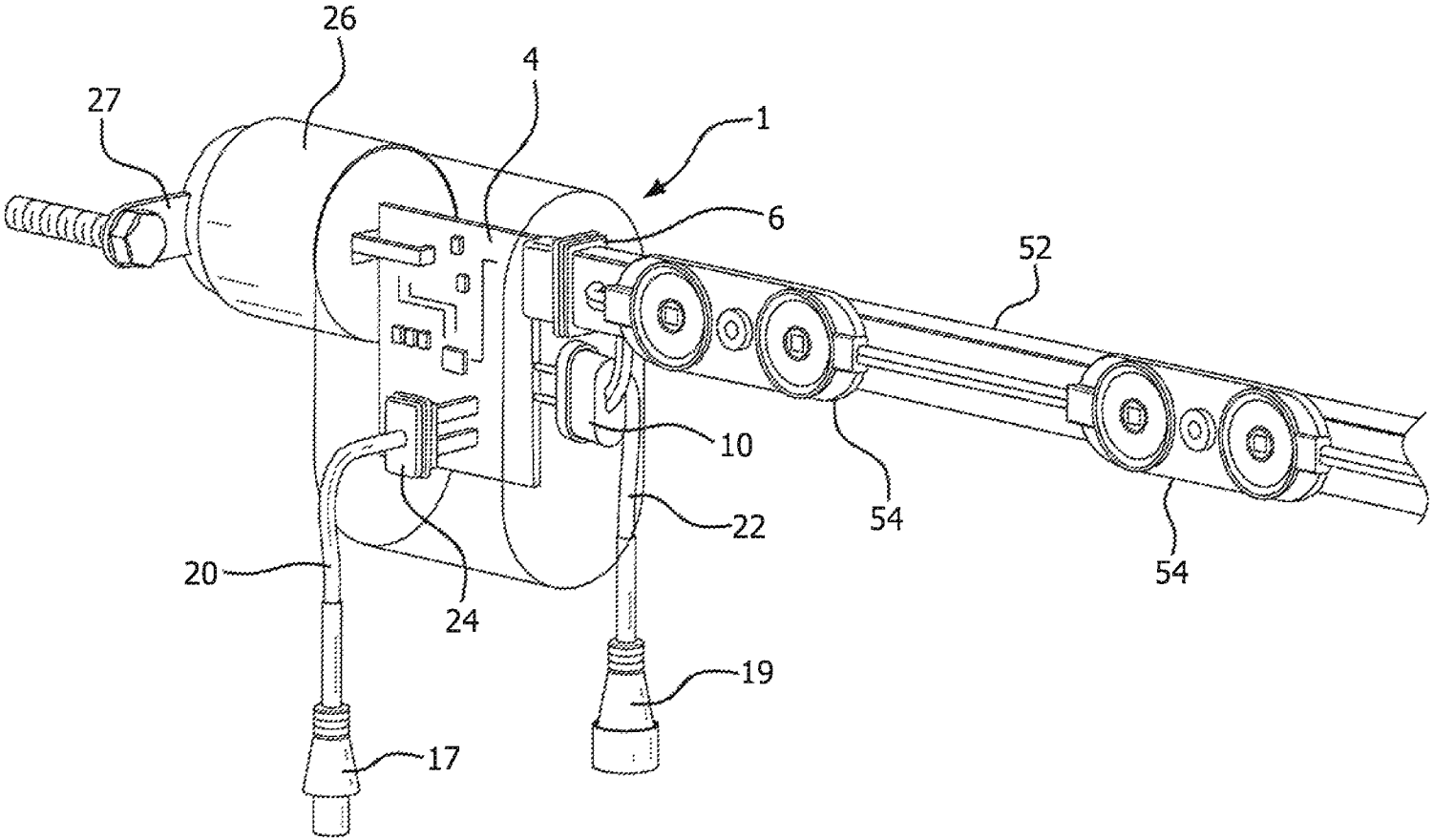
FIG. 3 is a view showing internal components of the power adapter of the present invention.

It is contemplated that the power adapters of the present invention, when used in a lamp signage system, will be connected by plugs to their respective power supply boards, as is shown in FIG. 3. Power adapters 30, 31, and 32 in lamp signage system 50 are interconnected by electrical wiring 39, 40, 41, and 42 and terminal connectors 43 and 44. High voltage electrical power for signage system 50 is inputted from an outside electrical power source via wiring 45 to power adapter 30. As the power adapters are either $AC^+/AC^-$ or $AC^-/AC^+$, the interconnecting electrical wiring serves to complete the electrical circuits between opposing adapters and the LED modules on module light sticks 36, 37, and 38.

As has been discussed, the electrical wiring from the LED module light stick is plugged directly into the power adapter of the present invention. In this manner the existing sockets in the lamp signage system become holders for the power adapters; and the power adapters supply power to the light sticks without the need to run any new wires from the light sticks to any power sources in the signage cabinet.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A high output electrical socket power adapter for electric lamp signage systems utilizing LED module lighting sticks, said power adapter comprising:

a housing containing an electrical power supply board, said housing comprising an orifice for receiving and maintaining an LED modular lighting stick inserted into the orifice, a female electrical receptacle for receiving a male electrical plug extending from said LED modular lighting stick, and openings for the passage of electrical connectors to provide power to and from the electric power supply board located within the housing, wherein high voltage electrical power from the power supply board is converted to lower voltage electrical power to the LED modular lighting stick.

2. The power adapter as in claim 1 wherein the high voltage electrical power ranges from 90 volts to 277 volts and the lower voltage electrical power ranges from 5 volts to 24 volts.

3. The power adapter as in claim 1 further comprising a mounting component secured to the power adapter for connecting the power adapter to an electrical lamp signage support frame.

4. A high output electrical socket lamp signage system comprising:

a lamp signage support frame;

a plurality of LED modular lighting sticks, each of said lighting sticks being attached to a power adapter, each said power adapter comprising:

a housing containing an electrical power supply board, said housing comprising an orifice for receiving and maintaining an LED modular lighting stick inserted into the orifice, a female electrical receptacle for receiving a male electrical plug extending from said LED modular lighting stick, and openings for the passage of electrical connectors to provide power to and from the electric power supply board located within the housing;

electrical wiring extending from each power adapter being interconnected with electrical wiring from an adjacent power adapter in the electrical lamp signage system, wherein high voltage electrical power from the power supply board of each power adapter is converted to lower voltage electrical power to the LED modular lighting stick; and mounting elements securing each power adapter to the support signage frame.

5. The system as in claim 4 wherein the higher voltage electrical power ranges from 90 volts to 277 volts and the lower voltage electrical power ranges from 5 volts to 24 volts.

* * * * *